United States Patent [19]

Sulimierski

[11] Patent Number: 4,800,832

[45] Date of Patent: Jan. 31, 1989

[54] RECREATIONAL BOAT

[76] Inventor: Edmund J. Sulimierski, 151 La Rose Avenue, Apt. 309, Weston, Ontario,, Canada, M9P 1B3

[21] Appl. No.: 23,010

[22] Filed: Mar. 6, 1987

[51] Int. Cl.[4] ..... B63B 7/04

[52] U.S. Cl. ..... 114/352; 440/101; 440/104; 280/47.13 B; 114/344

[58] Field of Search ..... 114/352, 353, 354, 123, 114/125; 440/101, 102, 103, 104, 105, 106, 107, 108, 109, 110; 416/70 R, 71, 72, 73, 74; 280/47.13 R, 47.13 B; 180/906

[56] References Cited

U.S. PATENT DOCUMENTS

| | | | |
|---|---|---|---|
| 514,908 | 2/1894 | Burton | 114/352 |
| 1,282,537 | 10/1918 | Burkart | 416/71 |
| 1,492,400 | 4/1924 | Schimpff | 114/352 |
| 1,642,502 | 9/1927 | Krasberg | 280/47.13 R |
| 1,958,008 | 5/1934 | MacDougall | 440/102 |
| 2,129,788 | 9/1938 | Scruggs | 114/352 |
| 2,292,972 | 8/1942 | Rice | 114/352 |
| 2,339,782 | 1/1944 | Johnson | 114/352 |
| 2,544,599 | 3/1951 | Keelen | 114/364 |
| 2,551,040 | 5/1951 | Newell | 280/47.13 B |
| 2,928,108 | 3/1960 | Cochrane et al. | 114/125 |
| 3,023,431 | 3/1962 | Applegate | 114/352 |
| 3,093,386 | 6/1963 | Case | 280/47.13 B |
| 3,362,033 | 1/1968 | Fee | 416/72 |
| 3,462,781 | 8/1969 | Olvera | 280/47.13 B |
| 3,611,458 | 10/1971 | Gonzalez | 114/352 |
| 4,522,145 | 6/1985 | Stone | 114/352 |

FOREIGN PATENT DOCUMENTS

| | | | |
|---|---|---|---|
| 118488 | 7/1983 | Japan | 114/352 |

*Primary Examiner*—Joseph F. Peters, Jr.
*Assistant Examiner*—Thomas J. Brahan
*Attorney, Agent, or Firm*—Fetherstonhaugh & Co.

[57] ABSTRACT

A knock-down boat assembly comprises bow, mid and stern water-tight transverse hull sections, each having fore and aft ends, concave side walls and a transverse bulkhead at the aft end of the bow section, at the fore and aft ends of the mid section and at the fore end of the stern section. The stern section is nestable in the mid-section and the bow section is nestable in the stern section when in the knock-down configuration. The forward bulkhead of the stern section is secured in a position butting against the aft bulkhead of the mid-section and the aft bulkhead of the bow section is secured in a position butting against the fore bulkhead of the mid-section when the boat is assembled for sailing. The side walls of the mid-section each have a short length extending from the aft bulkhead thereof which extends obliquely outwardly from the plane of the longitudinal curvature of the stern section such that the width of the aft end of the mid-section increases rapidly to a greater width than the fore end of the stern section whereby the stern section is nestable within the mid-section with the forward bulkhead located more closely adjacent the aft bulkhead than would be possible with a smooth longitudinal arc of curvature.

16 Claims, 13 Drawing Sheets

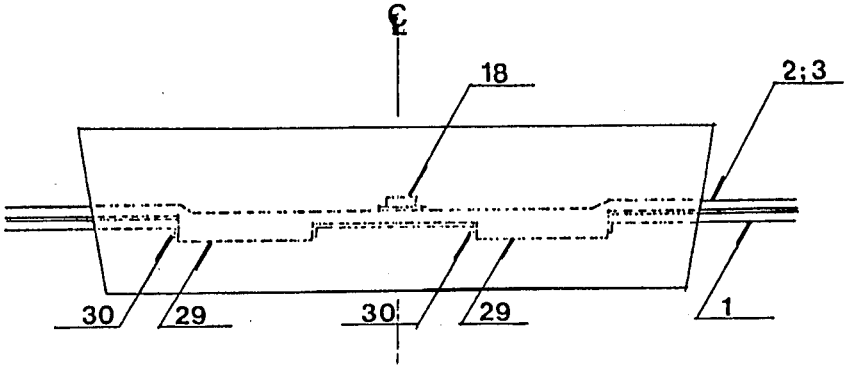
FIG. 14
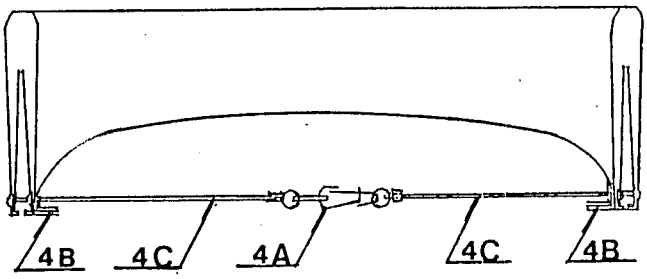
FIG. 15
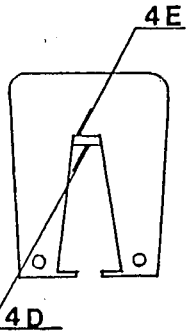
FIG. 16
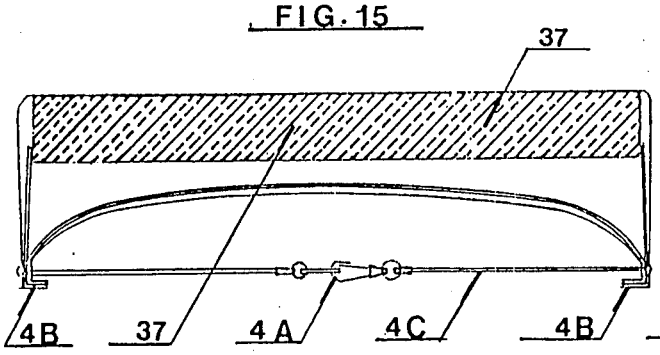
FIG. 17
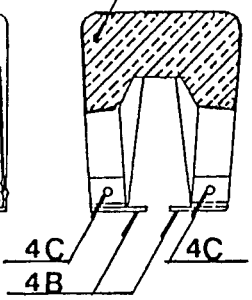
FIG. 18
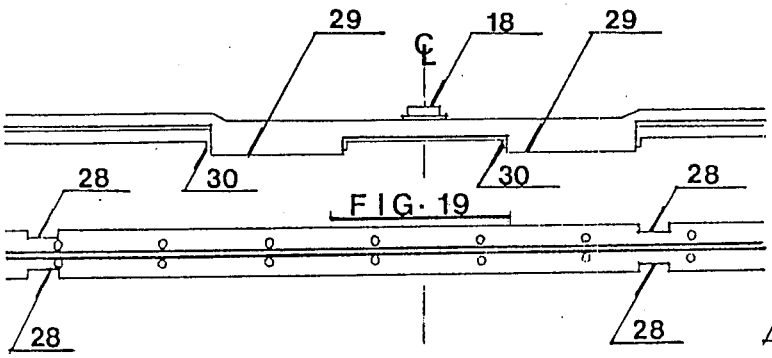
FIG. 19
FIG. 20
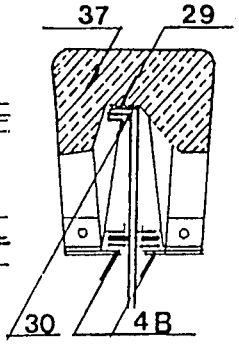
FIG. 21

RECREATIONAL BOAT

This invention relates to recreational boats and in particular, to boats which are made in sections which can be nested one within the other for storage and transportation.

PRIOR ART

A boat of the type to which the present invention relates is disclosed in European patent application No. 82103612.1, David Albert Smith. This prior boat is formed from four transverse sections and the sides of the boat when it is assembled follow a smooth and continuous arc of curvature. This smooth and continuous arc of curvature creates problems in attempting to nest the stern section within the larger of the two mid-sections because the length of the aft bulkhead of the mid-section is substantially equal to the length of the foreward bulkhead of the stern section which is disposed opposite it when these sections are nested. Because of the similarity in length, it is clear that the stern section must either extend a substantial distance above the mid-section or the bulkhead which are arranged adjacent one another must be spaced a substantial distance from one another when in the nested configuration. Thus, close nesting of the stern section in the mid-section is not possible. Furthermore, Smith does not provide any storage space for accommodating the other components which are required to provide a self-contained fully functioned powered boat when assembled. In addition, if the hull sections of the Smith boat were lined with buoyant liners which would have the effect of increasing the thickness of the walls of the sections and in particular, the bottom wall, the difficulties previously discussed with respect to nesting would become more pronounced. In the Smith structure, the adjacent bulkheads are secured by fasteners in the form of bolts when the sections are arranged in the assembled configuration. This type of fastening requires the recreational boater to carry tools for the purposes of assembling the boat. In many applications, such tools may not be readily available. Furthermore, the narrow transverse upper edges of the bulkheads do not provide comfortable seating and there is no provision in Smith for any comfortable seating.

The present invention overcomes the difficulties with the prior art described above and provides a simple and efficient self-contained easily transportable bolt assembly when in the knock-down configuration which can be erected without the aid of tools to provide a stable and buoyant boat for recreational use such as fishing.

According to one aspect of the present invention there is provided a knock-down boat assembly comprising bow, mid and stern water-tight transverse hull sections, each having, fore and aft ends, concave side walls and a transverse bulkhead at the aft end of the bow section, at the fore and aft ends of the mid section and at the fore end of the stern section; the stern section being nestable in the mid-section and the bow section being nestable in the stern section when in the knock-down configuration; the foreward bulkhead of the stern section being secured in a position butting against the aft bulkhead of the mid-section and the aft bulkhead of the bow section being secured in a position butting against the fore bulkhead of the mid-section when the boat is assembled for sailing; the side walls of the mid-section each having a short length extending from the aft bulkhead thereof which extends obliquely outwardly from the plane of the longitudinal curvature of the stern section such that the width of the aft end of the mid-section increases rapidly to a greater width than the fore end of the stern section whereby the stern section is nestable within the mid-section with the forward bulkhead located more closely adjacent the aft bulkhead than would be possible with a smooth longitudinal arc of curvature.

The invention will be more clearly understood after reference to the following detailed specification read in conjunction with the drawings wherein.

Figure 7:
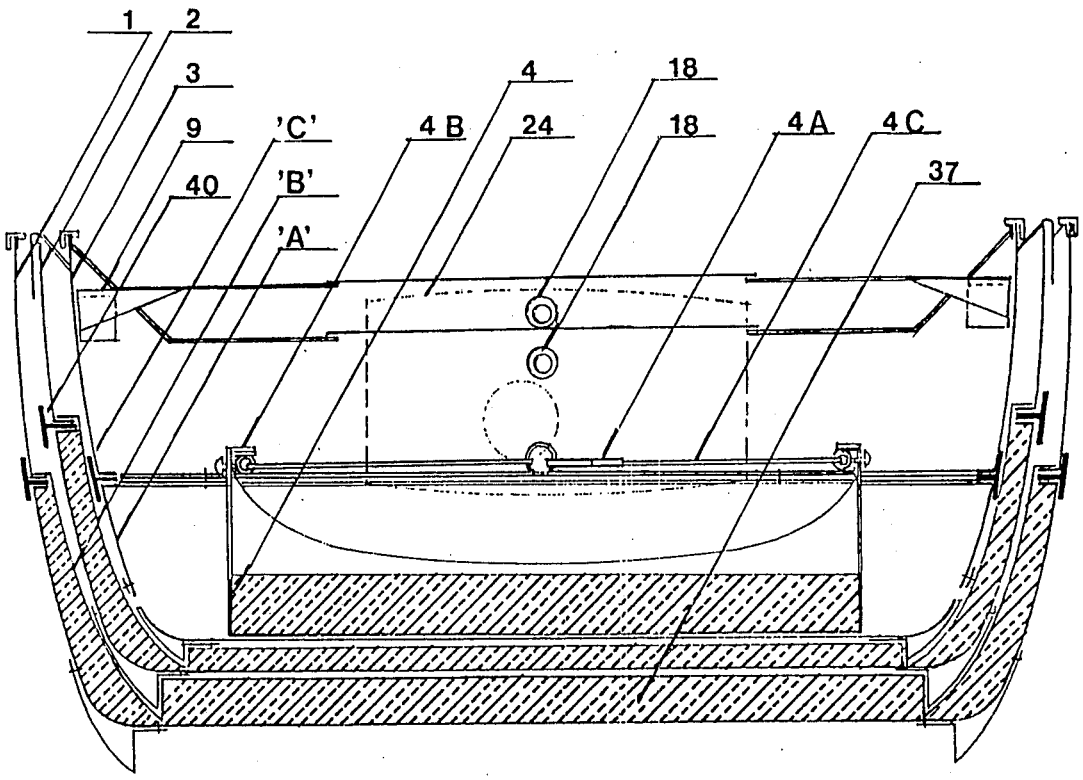
FIG. 7 is a cross sectional view taken through the knock-down assembly of FIG. 5.
Figure 7X:
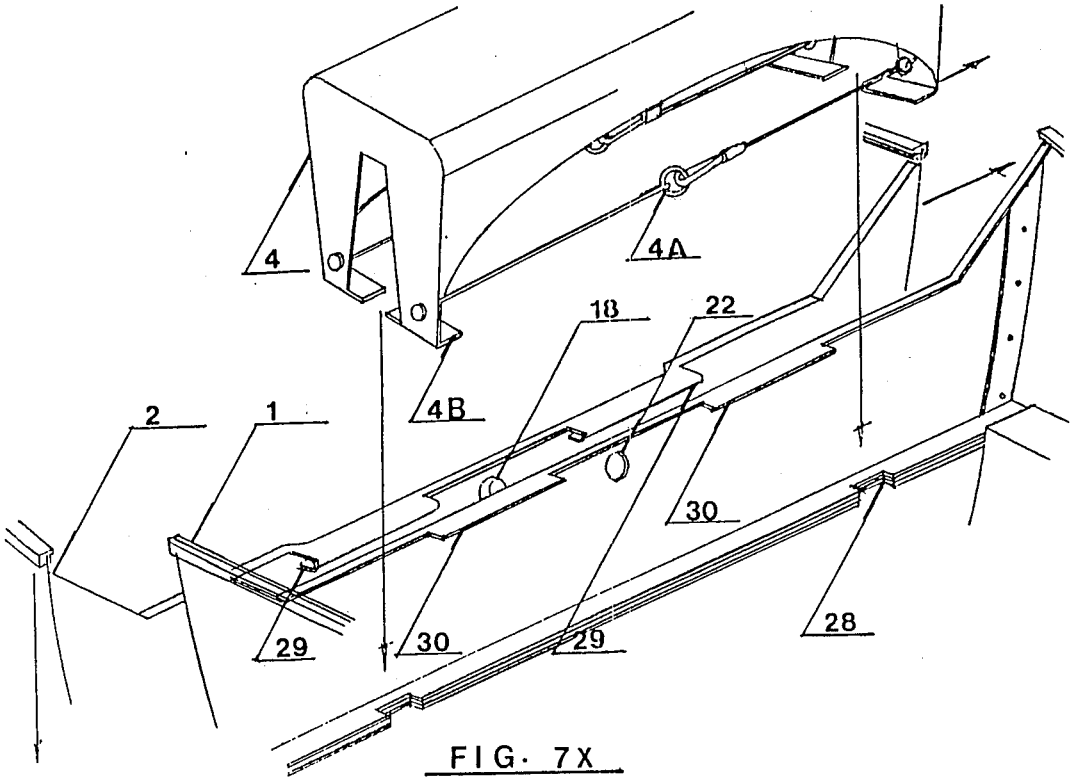
Figure 8:
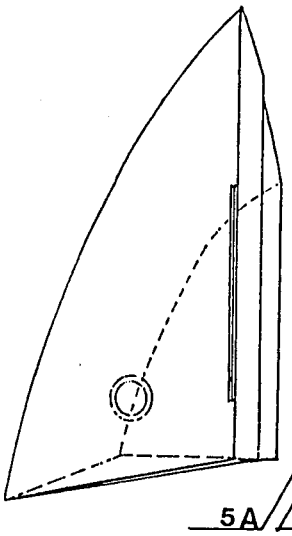
Figure 9:
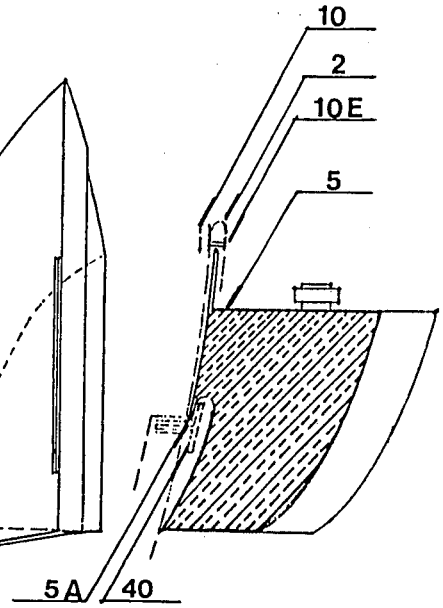
Figure 10:
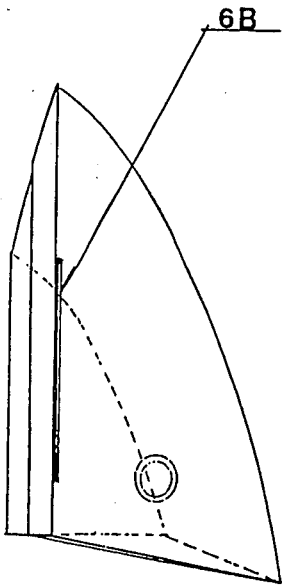
Figure 11:
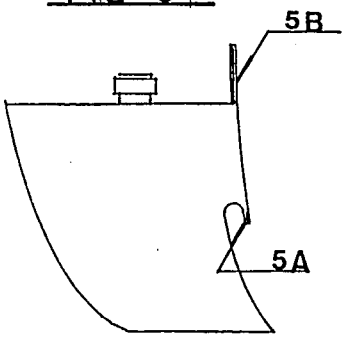
Figure 12:
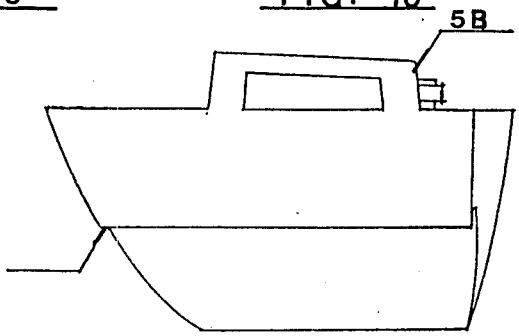
Figure 13:
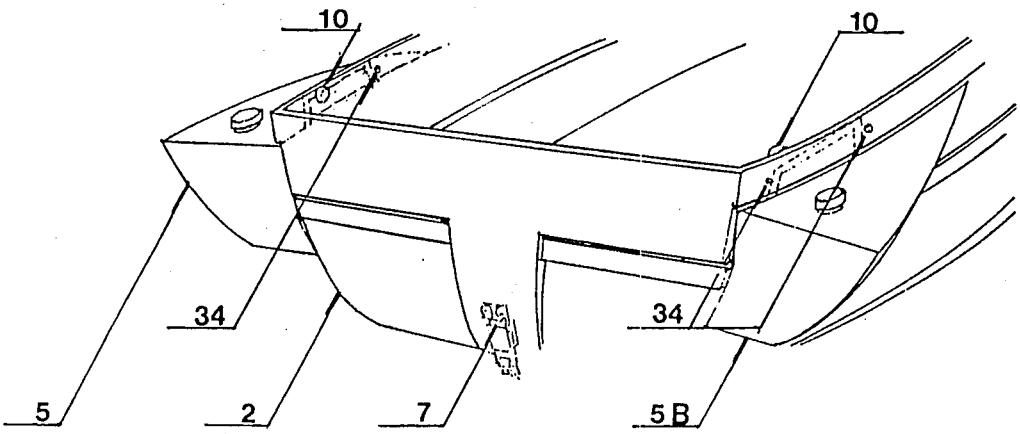
Figure 22:
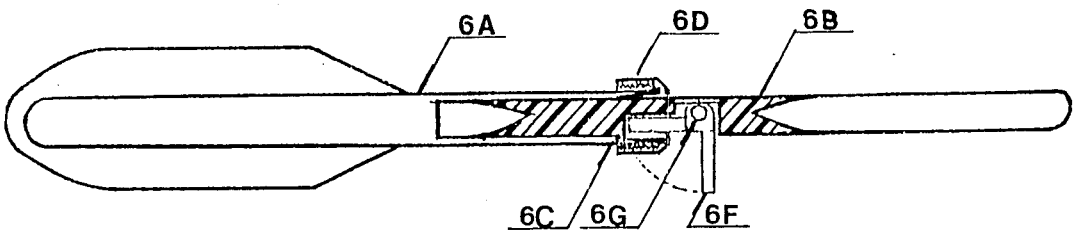
Figure 23:
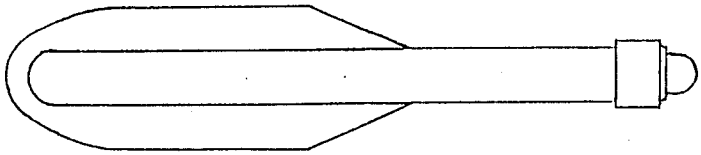
Figure 24:
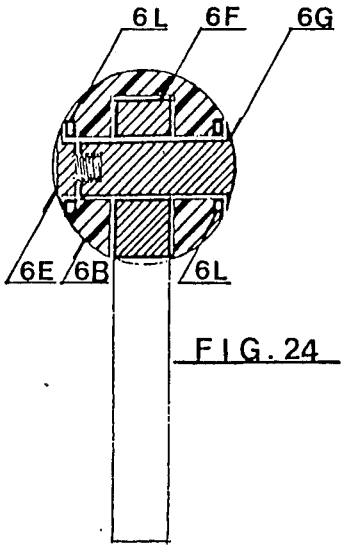
Figure 25:
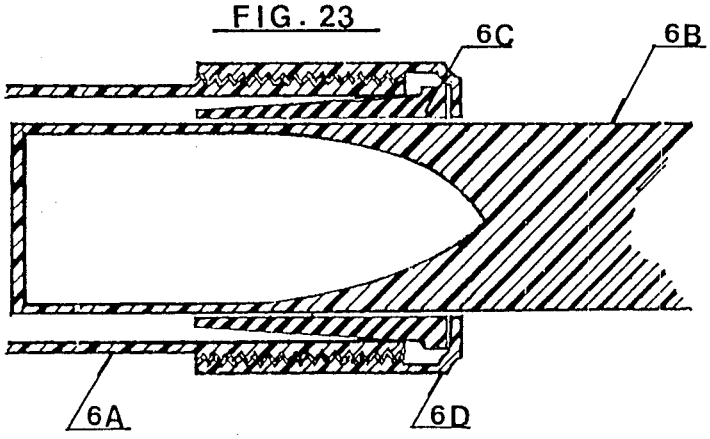
Figure 26:
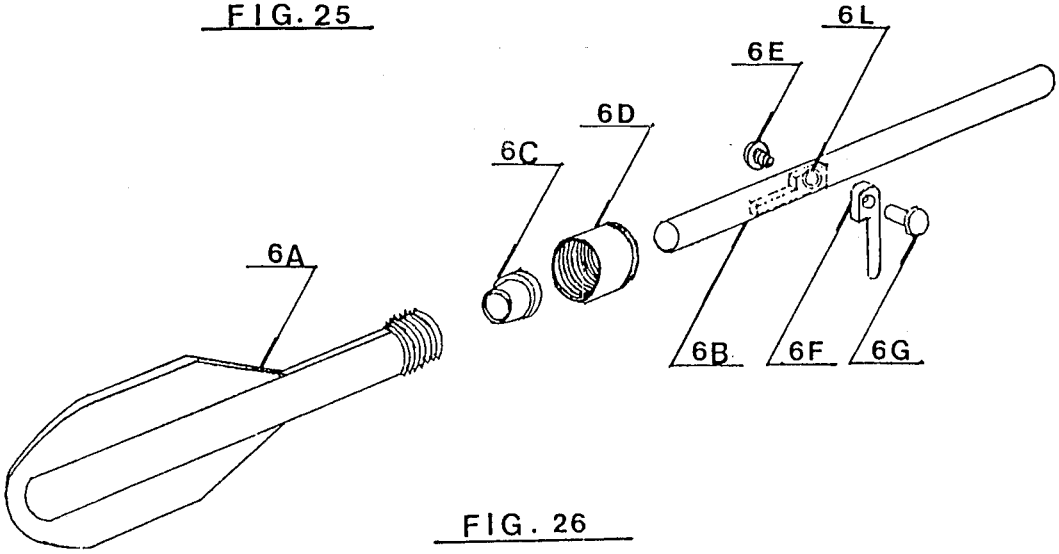
Figure 27:
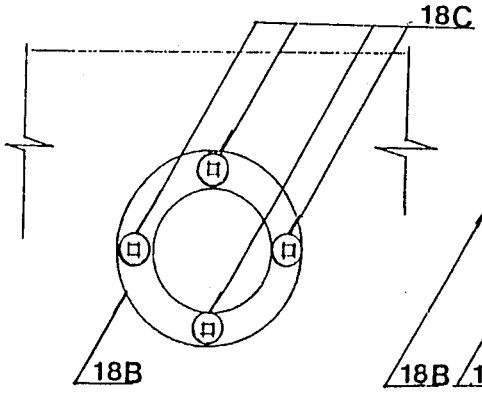
Figure 28:
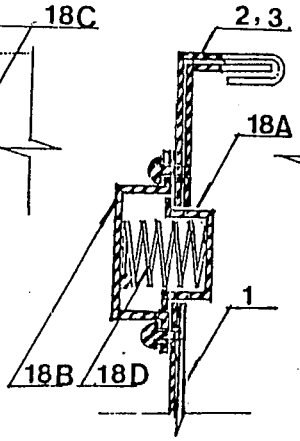
Figure 29:
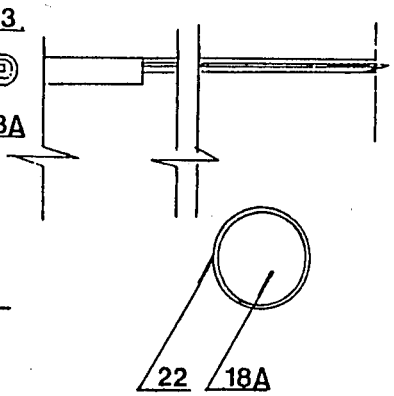
Figure 30:
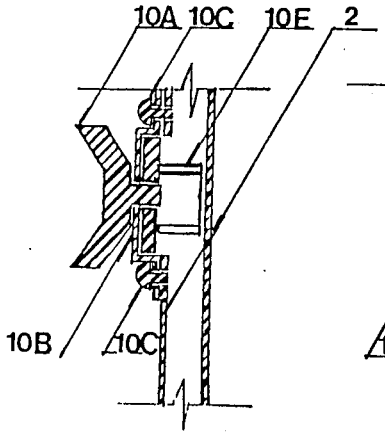
Figure 31:
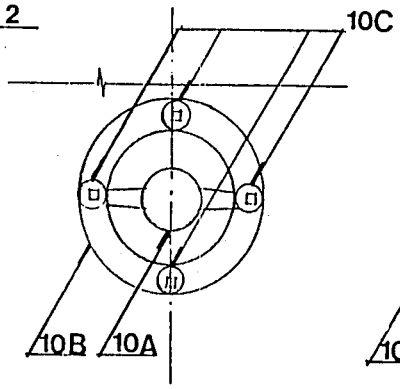
Figure 32:
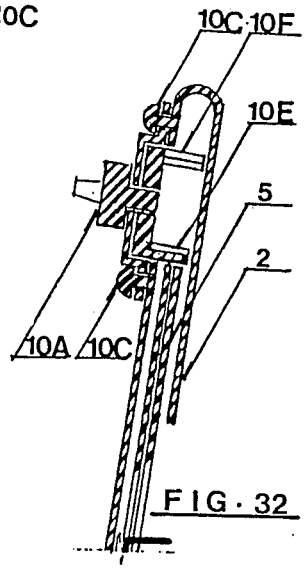
Figure 33:
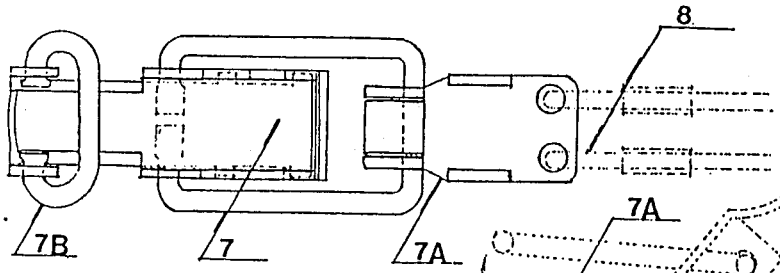
Figure 35:
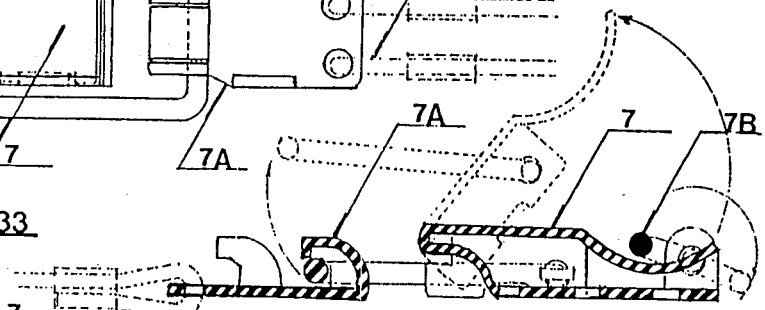
Figure 34:
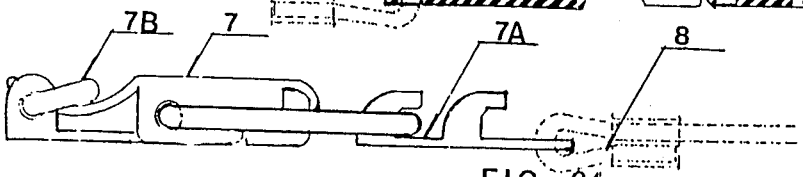
Figure 36:
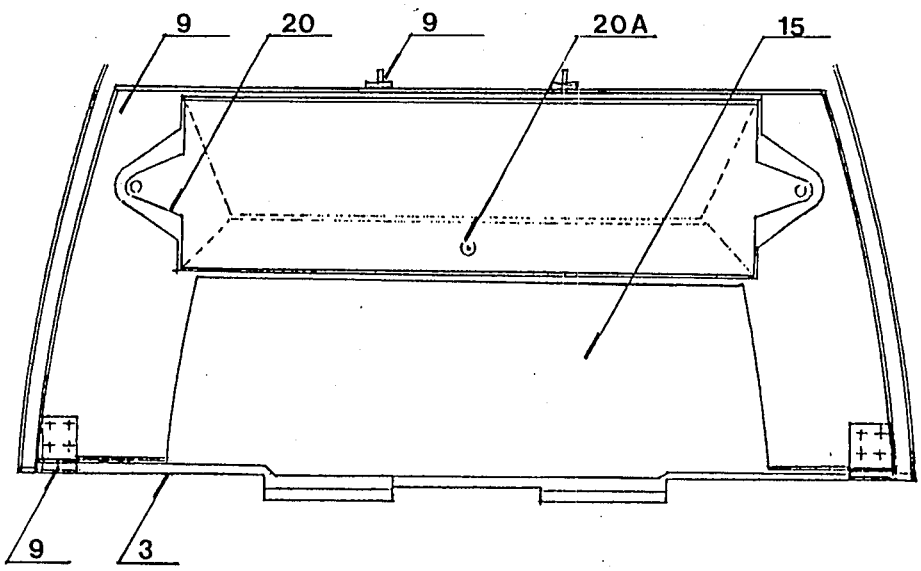
Figure 37:
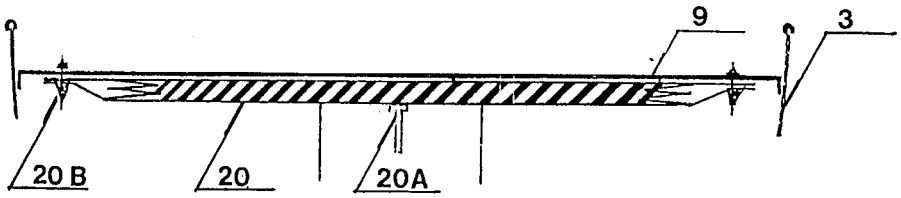

FIG. 7*x* is an exploded view illustrating the manner in which the seat is fitted to adjacent bulkheads for the purposes of securing the sections with respect to one another;

FIG. 8 is a plan view of a stabilizer tank;

FIG. 9 is a sectional side view of a stabilizer tank showing the manner in which it is mounted on the side of the stern section;

FIG. 10 is a plan view of the storage tank of the opposite hand to that illustrated in FIG. 8;

FIG. 11 is an end view of the storage tank illustrated in FIG. 8;

FIG. 12 is a side view of the inner face of the storage tank of FIG. 10;

FIG. 13 is a view illustrating the manner in which the stabilizer tanks are located on opposite sides of the stern section of the boat;

FIG. 14 is a plan view of the seat showing the manner in which it is mounted on adjacent bulkheads;

FIG. 15 is a front elevation of the seat of FIG. 14;

FIG. 16 is a side view of the seat of FIG. 15;

FIG. 17 is a longitudinal sectional view through the seat of FIG. 15;

FIG. 18 is a cross sectional side view through the seat of FIG. 16;

FIG. 19 is a plan view showing the connection between adjacent bulkheads;

FIG. 20 is a sectional view taken through adjacent bulkheads illustrating the seat mounting flange;

FIG. 21 is a sectional side view showing the seat operably mounted in a position connecting the adjacent bulkheads;

FIG. 22 is a longitudinal section through an oar assembly;

FIG. 23 is a view of the oar of FIG. 22 in the telescoped position;

FIG. 24 is a sectional view through the oar handle portion of the oar of FIG. 22 showing the rowing pin in a deployed position;

FIG. 25 is a sectional view through a portion of the oar of FIG. 22 showing the clamping mechanism used for locking the oar in the extended oar retracted position;

FIG. 26 is an exploded view of the oar assembly of FIG. 22;

FIG. 27 is a front elevation of the centering mechanism used for maintaining centre alignment of the oppositely disposed bulkheads when the boat is in the erected configuration;

FIG. 28 is a sectional side view taken through the centering device of FIG. 27;

FIG. 29 is a rear elevation of the centering mechanism of FIG. 27;

FIG. 30 is a side view of the mechanism used for locking the mounting mechanism used for mounting the stabilizer tanks on the side of the boat;

FIG. 31 is a front elevation of the mounting mechanism of FIG. 30;

FIG. 32 is a sectional side view similar to FIG. 30 showing a locking mechanism rotated through 90°;

FIG. 33 is a plan view of the toggle mechanism used for connecting both ends of the tensioning cables;

FIG. 34 is a side view of the toggle mechanism of FIG. 33;

FIG. 35 is a sectional side view of the mechanism of FIG. 34 showing an intermediate position in the locking operation;

FIG. 36 is a plan view of the fish storage compartment of the bow section;

FIG. 37 is a sectional view through the upper wall of the fish storage compartment showing an inflatable bladder in the collapsed position.

Figure 38:
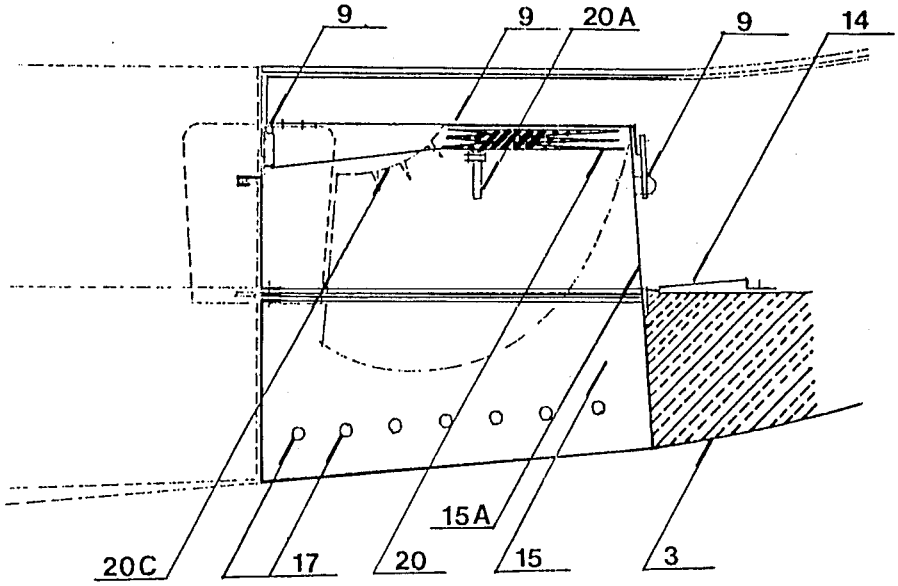
Figure 39:
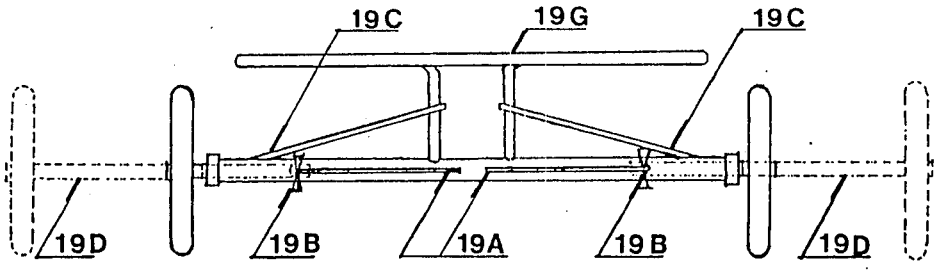
Figure 40:
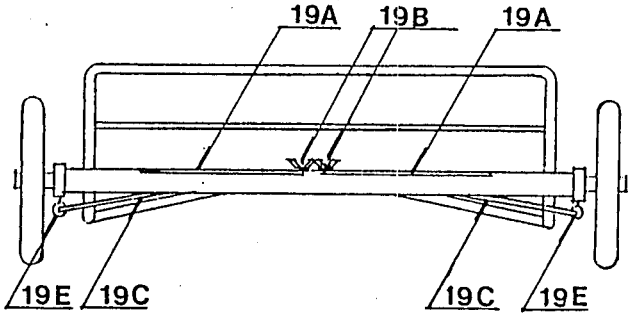
Figure 41:
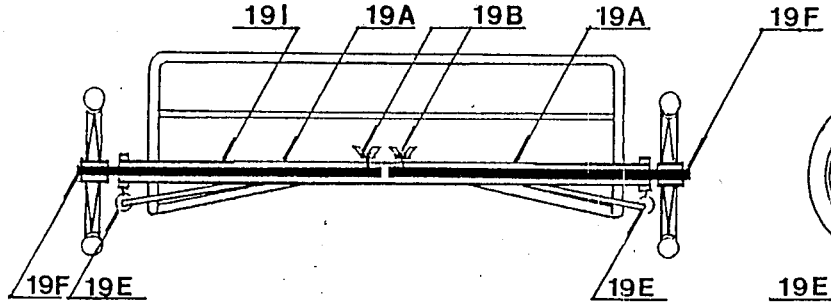
Figure 42:
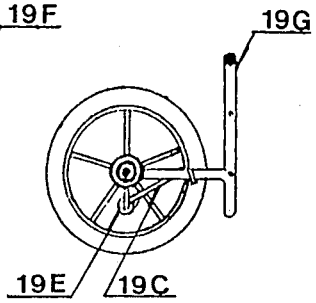
Figure 43:
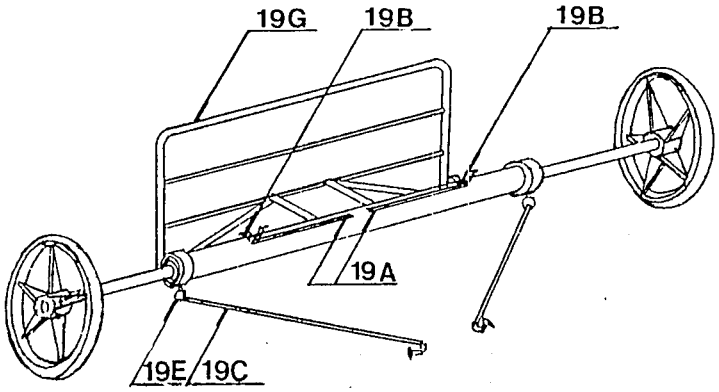
Figure 44:
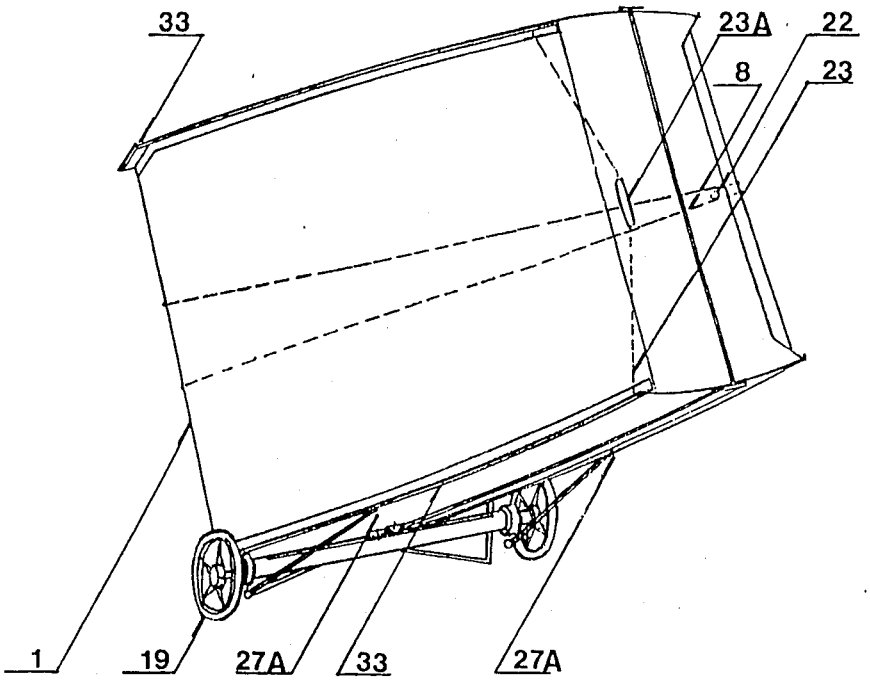
Figure 45:
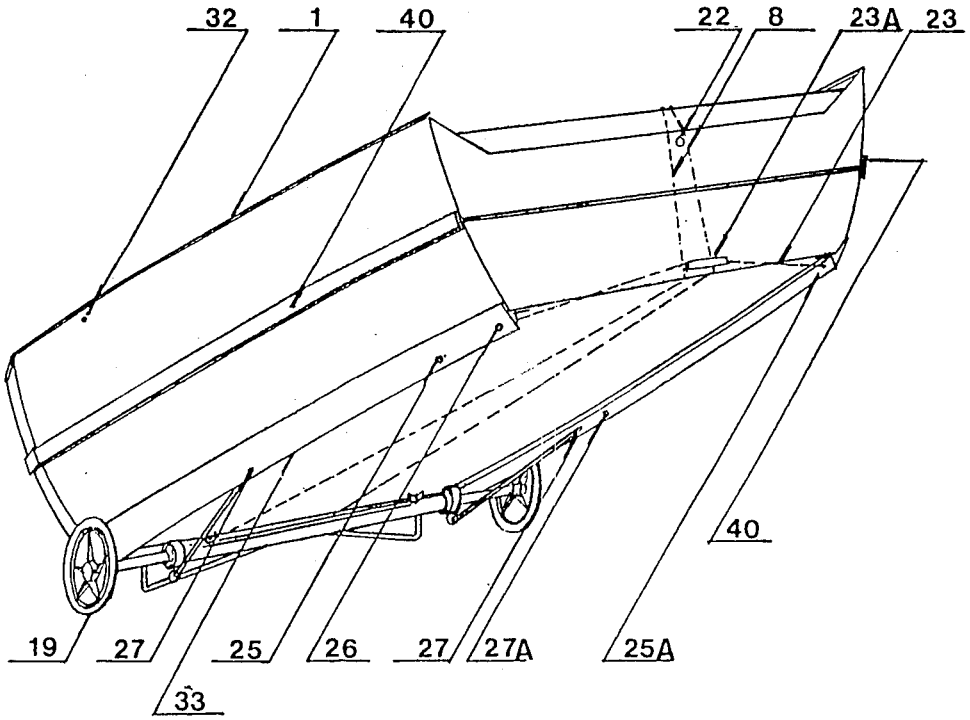

FIG. 38 is a sectional side view taken through the fish storage compartment of FIG. 36;

FIG. 39 is a plan view of an under carriage suitable for supporting the collapsed boat for towing purposes;

FIG. 40 is a front elevation of the under carriage of FIG. 39;

FIG. 41 is a sectional view of the under carriage of FIG. 40;

FIG. 42 is a sectional end view of the under carriage of FIG. 40;

FIG. 43 is a perspective view of the under carriage of FIG. 39 shown in the extended position;

FIG. 44 is a perspective view showing the boat in a knocked-down configuration mounted on its side on the under carriage for towing purposes;

FIG. 45 is a perspective view showing the boat in an upright configuration mounted on the under carriage for towing.

FIGS. 1 to 4 of the drawings show the boat of the present invention assembled for sailing purposes.

The boat consists of three water tight transverse hull sections. The reference numeral 1 refers generally to the mid-section, the reference numeral 2 refers generally to the stern section and the reference numeral 3 refers generally to the bow section. The boat also has seats 4 and side stabilizer tanks 5 which function as additional fuel storage tanks. Oars 6 are also provided. As will be described hereinafter, the boat is retained in the assembled position shown in FIG. 1 by means of a tendon 8, one end of which is looped around one of the notches 16 formed in the bow ridge 35 and the other end of which is connected to the toggle connector 7.

The bow section 3 has a fish storage compartment 15 formed adjacent its stern bulkhead. An open storage compartment is formed between the forward end of the fish storage compartment 15 and bow of the boat.

A plurality of opening 17 open through the side wall of the bow section into the fish storage compartment 15 so that the fish storage compartment 15 can be at least partially flooded when the boat is floating in a body of water. The front wall of the fish storage compartment 15 has an opening 15*a* formed therein to accommodate the motor 24 when the motor 24 is in the storage position as will be described hereinafter.

A buoyancy liner 37 in the form of a body of foamed plastic material is located in the bottom of the open storage compartment formed at the forward end of the stern section and a metal support plate 14 is located above the bouyancy liner 37 to protect it from damage by the motor 24 when the motor is in the storage position. The buoyancy liner 37 may be in the form of a closed cell styrofoam and serves to add buoyancy to the forward section so that the forward section is in itself buoyant despite flooding of the fish storage compartment. Fish storage compartment 15 also has a top wall 9 on the underside of which an inflatable bladder 20 is located. The bladder 20 is retained on the underside of the wall 9 by fasteners 20*b*. The bladder 20 has an inlet tube 20*a* (FIG. 37) which can be used for the purposes of inflating the bladder. The bladder is inflatable from the position shown in FIG. 37 to the position shown in FIG. 38. The portion 20*c* of the wall of the bladder serves to close the upwardly opening passage which is normally formed in the fish storage compartment to provide access to the fish storage compartment. The top wall 9 of the fish storage compartment is hingedly mounted on the stern bulkhead by means of a hinge 9*a* and is releasably retained in the closed position by means of a latching mechanism 9*b* (FIG. 38).

Figure 6:
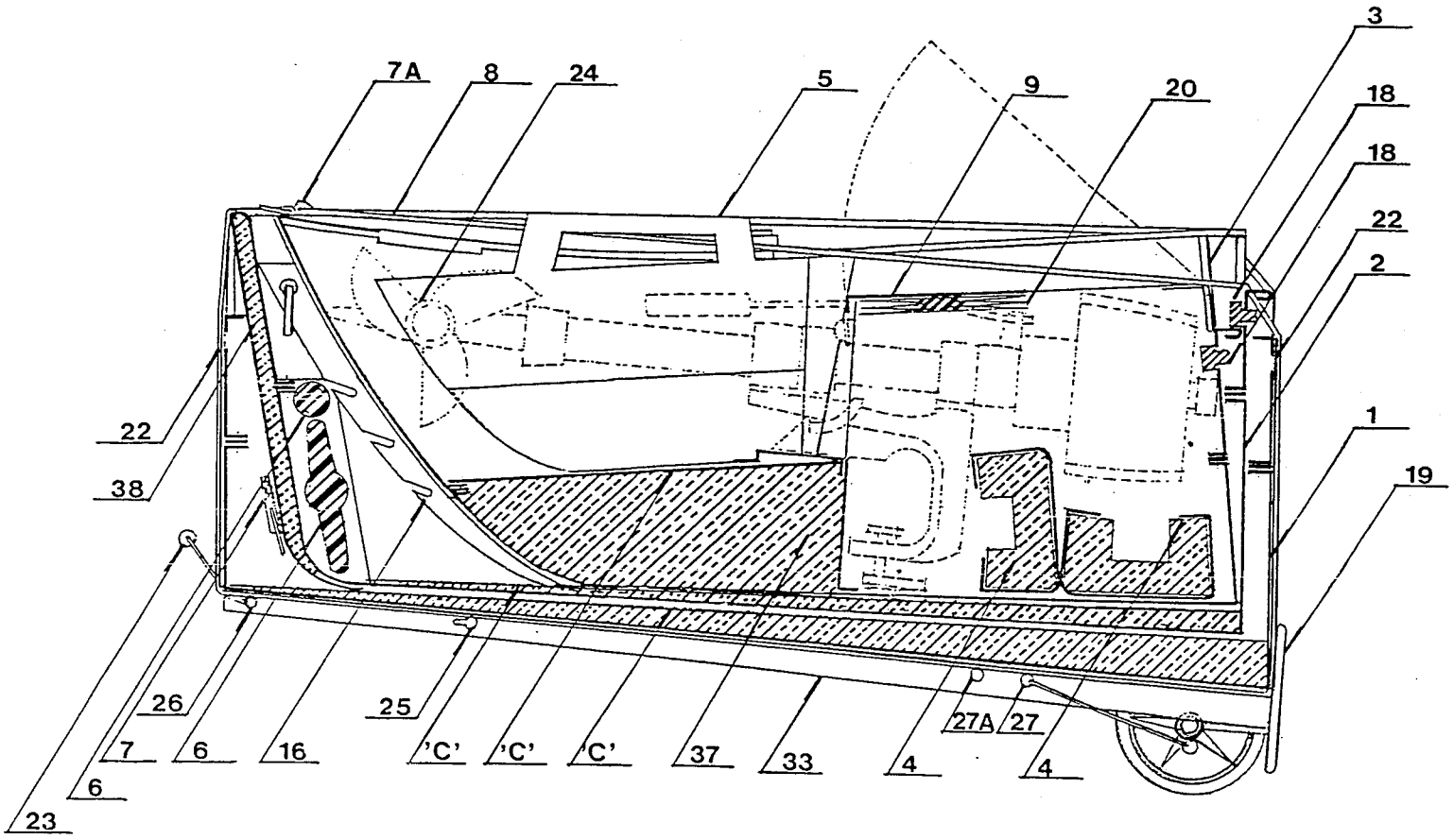
FIG. 6 is a sectional side view of the boat illustrated in FIG. 5.

The mid-section 1 also has a buoyancy liner 37 extending along its bottom wall. The thickness of the buoyancy liner 37 increases progressively from the forward end to the aft end of the mid-section. A further important feature of the mid-section is the fact that the side walls of the mid-section diverge rapidly from their point of connection to the aft bulkhead of the mid-section so that the width of the mid-section increases rapidly over a short distance from its aft bulkhead. This provides an area within the mid-section adjacent its aft bulkhead which is sufficiently wide to accommodate the forward end of the stern section when the stern section is nested therein without requiring that the stern section project a substantial height above the upper edge of the side walls of the mid-section. In addition, it will be noted that the upper edge of the side walls of the mid-section also extend upwardly from the stern section so that when the sections are nested, the upper edge of the mid-section will only extend a short distance above the upper edge of the mid-section as shown in FIG. 6 of the drawings. This provides a compact nested configuration.

Also with regard to the mid-section 1, it will be noted that the buoyancy liner 37 extends upwardly over the side walls to above half the height of the side walls.

Figure 4:
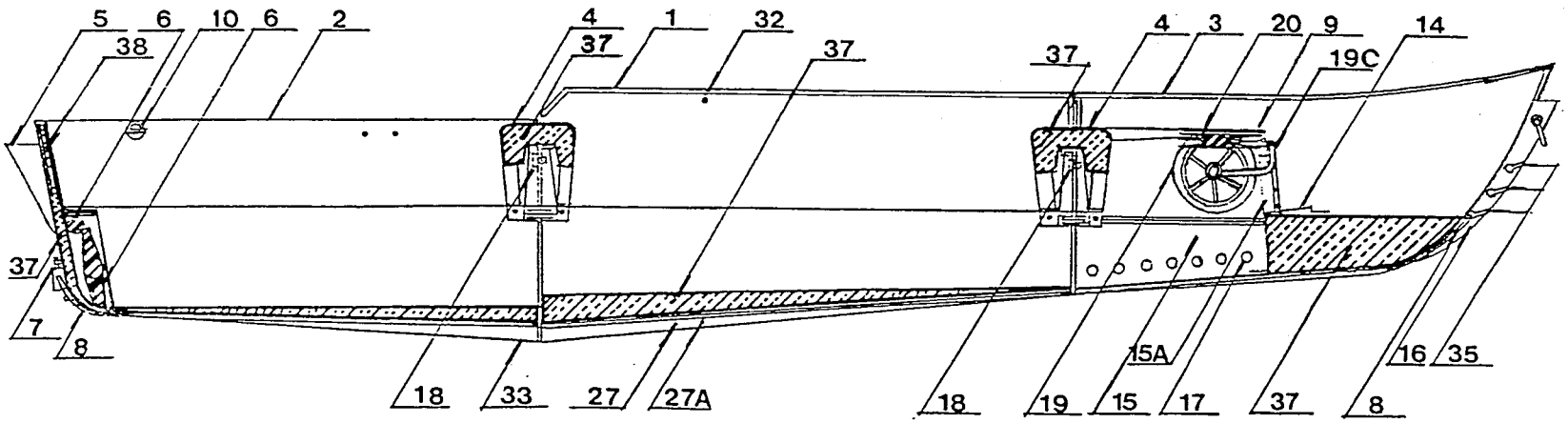
FIG. 4 is a longitudinal sectional view of the boat of FIG. 3.

The stern section 2 also has a buoyancy liner 37 which adds to the buoyancy of the stern section. The buoyancy liner does, however, extend upwardly over the side walls of the stern section to about half the height of the stern section. A notch 13 is formed in the buoyancy liner adjacent the stern bulkhead and this provides a locating recess for locating the blade portions of the oars during storage as shown in FIG. 4 of the drawings.

Oar mounting brackets 12 are mounted on the side walls of the stern section to receive the oar pins 6f. The stern section also has a seat 11 hingedly mounted on one side wall for movement between a horizontal position in which it provides a seat for the helmsman. The seat 11 can also pivot to a position in which it extends downwardly to lie flat against the side wall when in the storage position.

Figure 1:
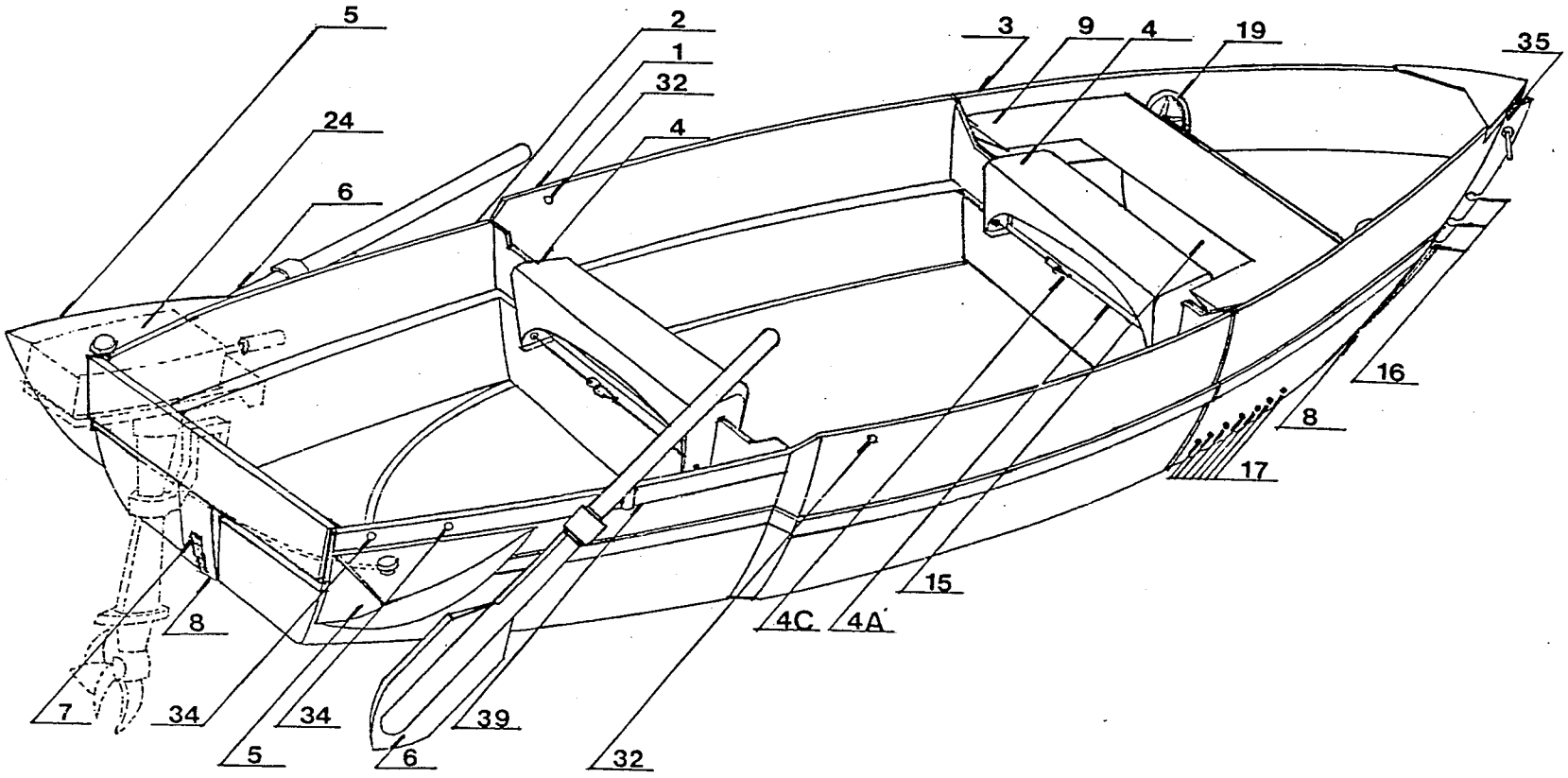
FIG. 1 is a perspective view of an assembled boat according to an embodiment of the present invention.
Figure 2:
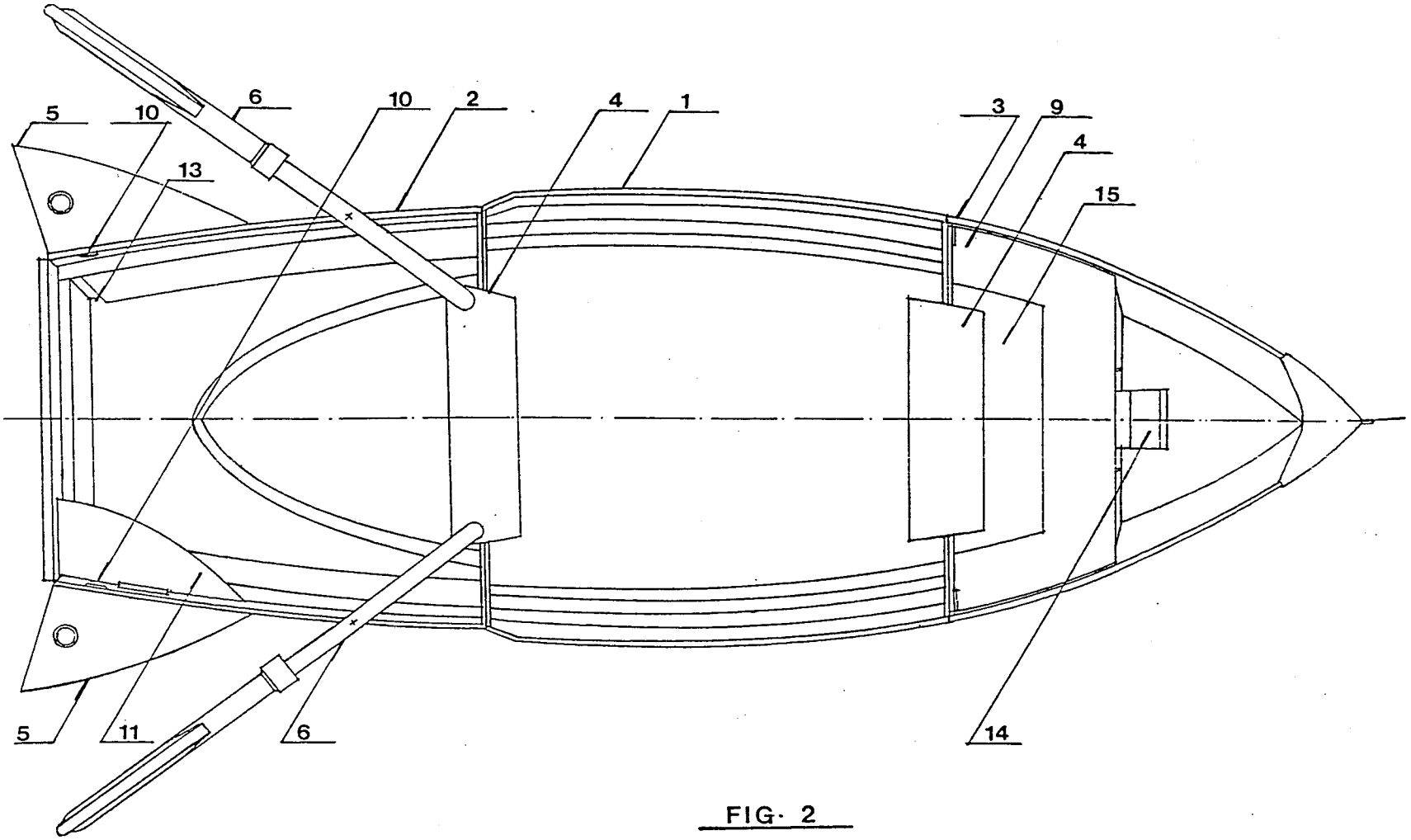
FIG. 2 is a plan view of the boat of FIG. 1.
Figure 3:
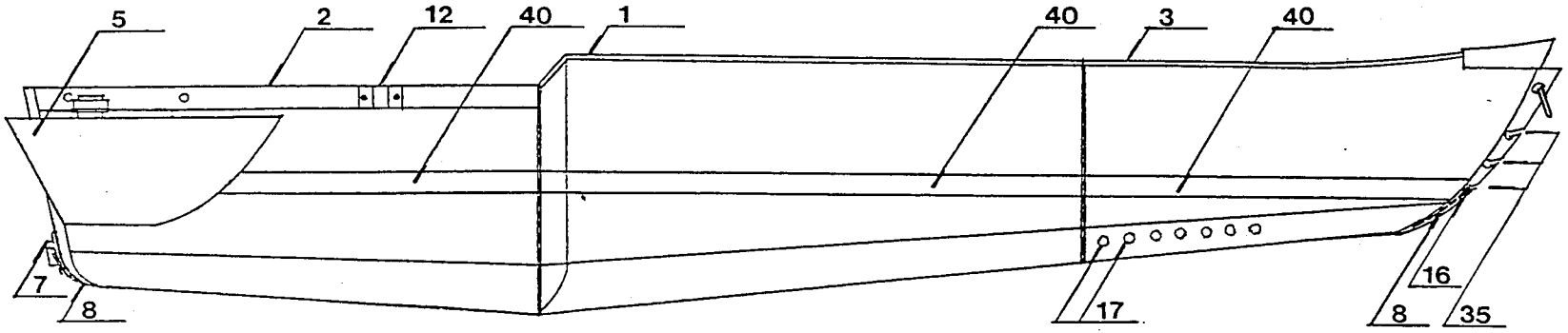
FIG. 3 is a side view of the boat illustrated in FIG. 2.

The stabilizer tanks are releasably mounted on the outer face of the side walls and are secured by a mounting mechanism 10 which is illustrated in detail in FIG. 30, 31 and 32. The storage tanks 5 can also be positioned in the forward storage compartment of the bow section as shown in FIG. 6 of the drawings. For the purposes of permitting the tanks 5 to be stored in the forward storage compartment, the outer side faces of the tanks each have an arcuate curvature corresponding to that of the hull in the forward storage compartment so that these tanks will fit conveniently in the forward storage compartment. The tanks 5 may be used for the purposes of storing fuel and will act as outriggers which serve to add further stability to the boat in use. As shown in FIGS. 8 to 13 of the drawings, each of the tanks 5 is formed with a mounting lip 5*a* which extends longitudinally thereof and a handle 5*b*. The mounting lip 5*a* is proportioned to fit into a slot formed along the upper edge of the T-shaped reinforcing bar 40 which extends longitudinally of each hull section as shown in FIG. 1 of the drawings. The handle 5*b* projects into the downwardly opening channel formed along the upper edge of the side walls of the stern section as shown in FIG. 9 of the drawings. A locking device 10 is provided for securing the handle with respect to the stern section 2. The clamping device 10 is illustrated in detail in FIGS. 30, 31 and 32 to which reference is now made. As shown in these figures, a face plate 10*b* is mounted by means of mounting screws 10*c* on the side wall of the stern section 2. A butterfly nut 10*a* is mounted for rotation in the plate 10*b* and has a lug portion 10*e* projecting outwardly therefrom. When the lug 10*e* is in the position shown in FIG. 32 in solid line, it will engage the handle portion of the stabilizer tank and will limit the extent of vertical movement of the stabilizer tank with respect to the hull section 2. When in the position shown in broken lines in FIG. 32, the stabilizer tanks 5 are free to rise and fall, with respect to the hull section to facilitate the mounting and removal of the stabilizer tanks.

The structure of the various sections of the hull, a centering mechanism is provided and is generally identified by the reference numeral 18.

To center the various sections of the hull, a centering mechanism is provided and is generally identified by the reference numeral 18 in FIGS. 4, 5 and 27 to 29. A centering passage 22 (FIG. 29) is formed in the fore and aft bulkheads of the mid-section 1. The centering mechanism as shown in FIGS. 28 and 29, includes a fixed cover 18*b* which is secured by means of mounding screws 18*c* to the aft and forward bulkheads of the bow and stern sections respectively. A centering plate 18*a* is mounted to telescope in the cover 18*b* and is normally urged to the extended position shown in FIG. 28 by means of a compression spring 18*d*. The plate 18*a* has a cylindrical protrusion formed thereon which is proportioned to fit in a close fitting relationship within the passage 22 as shown in FIG. 29. Thus, when the bow and stern sections are properly aligned with the mid-section, the cylindrical extrusion formed on the centering plate 18*a* will project through the passages 22 and serve to longitudinally align the bow and stern section while the tendons will serve to hold the sections against longitudinal separation. In order to separate the sections, the plate 18*a* can be telescoped into the cover 18*b* so as to be withdrawn from the passage 22 by compressing the spring 18*d*.

The seats 4 not only act as comfortable seats but also serve to secure the adjacent bulkheads of the sections to one another. In addition, the seats are useful as life preservers. As shown in FIGS. 19 to 21, the bulkheads of the mid-section 1 each have a lip portion 30 projecting laterally along the upper edge thereof and a flange portion projecting inwardly thereof at a point spaced below the upper edge. The adjacent bulkheads of the forward and stern sections 2 and 3 also have a lip portion 29 which is arranged to project over the lip portion 30 as shown in FIG. 21. The flanges which project from the bulkheads below the lips 29 and 30 are each formed with notches 28 which are aligned with one another. The seat 4 has a pair of oppositely disposed end plates in which a downwardly opening notch is formed, the end plates have lips 4*b* projecting inwardly of the notch which are arranged and proportioned to fit through the notches 28 (FIG. 20). A flexible belt 4*c* has two sections connected one to each end plate. One of the sections has a fastener 4*a* at its free end and the other has a fastening ring for engagement with the fastener 4*a*. The upper portion of the seat 4 is in the form of a buoyancy liner 37 which adds buoyancy to the seat so that it is useful as a life preserver and this same material acts as a seat padding. In use, the seats are mounted in a position connecting the adjacent bulkheads as shown in FIG. 21 of the drawings and can be removed merely by moving the seat longitudinally to align the lugs 4*b* with the notches 28*a* whereupon the seat can be lifted up out of engagement with the bulkheads.

The oars are illustrated in FIGS. 22 to 26 to which reference will now be made. Each oar includes a blade section 6*a* and a handle section 6*b*. The handle section 6*b* is arranged to telescope in the bore of the blade section 4*a* between the extended position shown in FIG. 22 and the contracted position shown in FIG. 23. The handle section 6*b* can be locked in the extended position or in the contracted position by means of a wedge sleeve 6*c* and a locking collar 6*d* which is threadedly mounted in the blade section 6*a*.

An oar pin 6*f* is pivotally mounted on the handle section 6*b* by means of a pivot pin 6*g* which is secured by a mounting screw 6*e*. The oar pin 6*f* is free to pivot between the position shown in solid lines and the position shown in broken lines in FIG. 22. When in the position shown in broken lines, the pin 6*f* is accommodated completely within a recess formed in the handle section.

The toggle connector 7 which is previously indicated, is used for the purpose of connecting the tendon 8 at the stern as shown in FIG. 4 of the drawings will now be described with reference to FIGS. 33 to 35. A mounting plate 7*a* is secured to the ends of the tendon 8 by looping the ends of the tendon 8 through openings formed in the plate 7*a*. The plate 7*a* has two sets of latching hooks. The latch member 7 has a rectangular-shaped latch ring, the distal end of which can be hooked over one or other of the latching hooks of the latch plate 7*a*. The latching ring is mounted on a hinge plate which can be hinged from the position shown in solid lines in FIG. 35 to the position shown in broken lines in FIG. 5 to facilitate the positioning of the latch ring over a selected latch hook of the latch plate 7*a*. A locking bar 7*b* is mounted to pivot between the positions shown in FIG. 35 to releaseably retain the latch plate in the position shown in solid lines in FIG. 35.

For the purposes of transporting the boat in a knocked-down configuration, an undercarriage 19 is provided. The undercarriage 19 will now be described with reference to FIGS. 39 to 43 of the drawings. As shown in FIG. 39, the undercarriage includes a tubular sleeve **19*i* slidably mounted in which are two axles 19*d*, each of which has a wheel mounted at its free end 19*f* for rotation thereon. A pair of slots 19*a* are formed in the wall of the tubular sleeve and extend longitudinally thereof. Locking screws extend from the axles 19*f* through the slots 19*a* and have wing nuts 19*b* thereon for use in clamping the axles at any required position along the length of the slot so as to permit adjustment of the width of the track of the undercarriage. The undercarriage also includes a frame structure which consists of a back wall 19*g* which is supported on a pair of spaced parallel arms which project radially from the sleeve 19*i*. A pair of stays 19*c* are provided for the purposes of securing the undercarriage to the underside of the knock-down boat. Each stay 19*c* has one end connected to a mounting eye 19*e* which is secured to the sleeve 19*i*. The free ends of the stays 19*c* are hook-shaped and when they are not used for connecting the undercarriage to the boat, these stays are hooked over the arms which project radially from the sleeve 19*i* as shown in FIG. 42** of the drawings.

When the boat is assembled for use as a boat as shown in FIGS. 1 to 4 of the drawing, the undercarriage 19 is stowed with the wheels mounted in the fish storage compartment of the bow section as shown in FIG. 4. Also when the boat is to be powered by a motor, the oars are stowed in the stern compartment as shown in FIG. 4. In the assembled configuration, the sections are centered by the centering mechanism and are retained by the tension in the tendons 8. The seats 4 also serve to retain the sections of the boat in the required assembled configuration.

Figure 5:
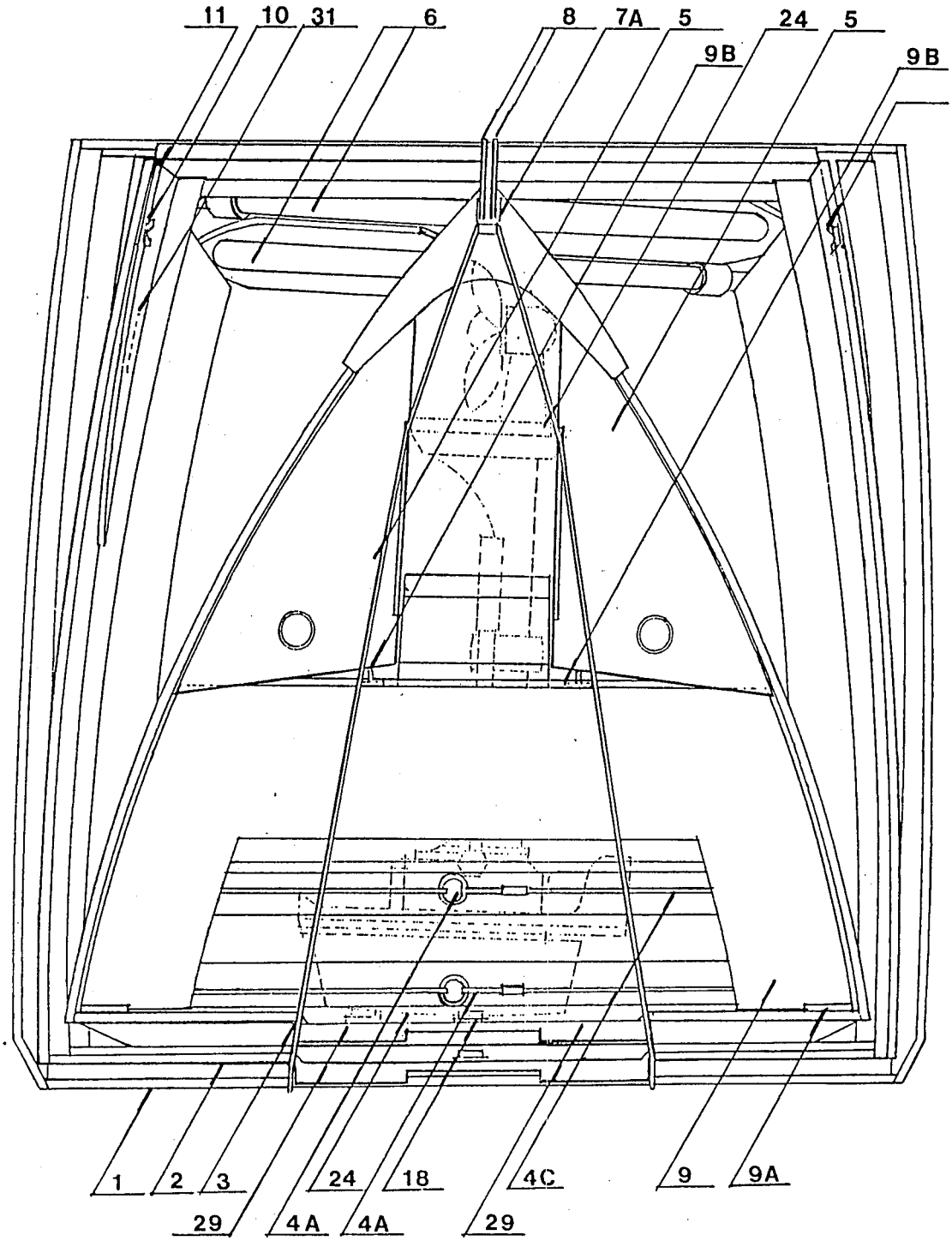
FIG. 5 is a plan view of the boat of the present invention arranged in the knock-down nested configuration.

When the boat is to be knocked-down for storage and transportation, the various sections are separated from one another and the stern section is nested in the mid-section with the forward bulkhead of the stern section located adjacent the aft bulkhead of the mid-section as shown in FIG. 5 of the drawings. The oars 6 are telescoped to the shortened configuration and are stowed in the stern section as shown in FIGS. 5 and 6 of the drawings. The bow section is then nested in the stern section as shown in FIGS. 5 and 6 of the drawings with the aft bulkhead of the bow section arranged adjacent the forward bulkhead of the stern section. The seats 4 are then stowed in the aft section as shown in FIGS. 5 and 6. Thereafter, the motor together with its mounting are stowed in the bow section with the prop 24 located adjacent the bow end of the bow section. The tendons are then wrapped around the knock-down configuration and the opposite ends of the tendons are connected as shown in FIG. 5 to secure the knock-down assembly in the nested configuration. It will be noted that the propositions of the boat and the assembled configuration and in the knock-down configuration are such that the same tendons 8 can be used to secure the sections without requiring any adjustment of the length of the tendons. Slight variations in the length of the tendons is taken into consideration by the provision of several notches 16 in the bow ridge. The undercarriage is then mounted on the knock-down assembly as illustrated in FIG. 44 or 45 so that the knock-down assembly can be transported either on at one edge as shown in FIG. 44 or in the upright configuration shown in FIG. 45.

From the foregoing, it will be apparent that the present invention provides a knock-down boat assembly which is capable of accommodating all of the essential components required for boating in a compact configuration while also being suitable for assembly to a stable sailing configuration.

I claim:

1. A knock-down boat assembly comprising, bow, mid and stern water-tight hull sections, each having, fore and aft ends, concave side walls and a flat transverse bulkhead at the after end of the bow section, at the fore and aft ends of the mid section and at the fore end of the stern section, the concave side walls of the stern section converge continuously from it fore end bulkhead to its aft end bulkhead, the stern section being nestable in the mid-section and the bow section being nestable in the stern section when in the knock-down configuration, the side walls of the stern section converge continuously from the fore end bulkhead to the aft end bulkhead such that the width of the stern section is a maximum at the fore end, the forward bulkhead of the stern section being secured in a position butting against the aft bulkhead of the mid-section and the aft bulkhead of the bow section being secured in a position butting against the fore bulkhead of the mid-section when the boat is assembled for sailing, the side walls of the mid-section each having a short length extending from the aft bulkhead thereof which extends obliquely outwardly from the plane of the longitudinal curvature of the stern section such that the width of the aft end of the mid-section increases rapidly to a greater width than the maximum width of the stern section whereby the stern section is nestable within the mid-section with the forward bulkhead located more closely adjacent the after bulkhead than would be possible with a smooth longitudinal arc of curvature.

2. A knock-down boat as claimed in claim 1, wherein said short length of the side wall of the mid-section extends obliquely at an angle of 30° to the longitudinal plane of the hull.

3. A knock-down boat as claimed in claim 2, wherein the side wall of each section has an upper edge, the upper edge of the side walls of the mid-section being downwardly inclined along the short length thereof, the upper edge of the side walls of the stern section extending level with the maximum height of the upper edge of the mid-section and the maximum height of the upper edge of the bow section to form a flat upper edge of the nested assembly.

4. A knock-down boat as claimed in claim 3, wherein each section has a bottom wall portion and a buoyant liner member attached to the bottom wall of each section, the maximum height of the trimming of the bow section, when nested in the stern section and resting on the buoyant liner of the stern section being no greater than that of the stern section.

5. A knock-down boat as claimed in claim 4, wherein the buoyant liner member of the mid-section has a maximum height at its aft bulkhead and a buoyant liner of the stern section has a maximum height at its fore end to facilitate level nesting of the sections.

6. A boat as claimed in claim 1, further comprising stabilizer tanks releaseably mounted one on either side of the stern section adjacent the aft bulkhead thereof, each stabilizer tank having an inner face shaped to conform to the side wall of the stern section which they face when mounted thereon and an outer side face shaped to conform to the configuration of the inner face of a side wall of the bow section adjacent the bow end thereof whereby said stabilizer tanks may be positioned in the bow section for storage with the inner faces thereof disposed opposite one another and the outer faces arranged in a face-to-face relationship with the inner faces of the storage compartment of the bow section.

7. A boat as claimed in claim 1, further comprising tendon mounting means on said bow section and on said stern section, and tendon means mountable on the bow and stern mounting sections and extending externally and longitudinally between the bow and stern sections when the boat is assembled for sailing to retain the boat in a sailing configuration, and means for connecting opposite ends of said tendon means when the tendon means is extended around the knock-down assembly in the nested configuration in a fore to aft direction whereby the tendon means serve to retain the hull sections in the nested configuration.

8. A boat as claimed in claim 1, further comprising a stern seat panel hingedly mounted on an inner face of a side wall of the stern section adjacent the aft bulkhead of the stern section for movement between a laterally extending seating position and a downwardly folded storage position in which said seating panel extends in a face-to-face relationship with respect to the adjacent side wall of the stern section.

9. A boat as claimed in claim 1, further comprising a wheeled undercarriage for use when towing the knock-down boat along a roadway in an upright configuration or on its side, said undercarriage comprising a tubular sleeve, a pair of wheels each mounted for rotation on a stub shaft, said stub shafts being mounted one in each end of said sleeve and being arranged to telescope therein between an extended position in which the wheels are located laterally outwardly from the boat assembly when arranged in the upright configuration and a retracted position in which the wheels are located laterally outwardly from the boat assembly when arranged on its side, and means for releaseably locking said stub shaft with respect to said tubular sleeve to releaseably retain said wheels in said extended or retracted position.

10. A boat as claimed in claim 9, wherein said undercarriage further comprises a support frame which is mounted on said tubular sleeve, said support frame comprising a first pair of spaced frame members projecting radially from the tubular sleeve, a back wall extending perpendicularly from said first pair of frame members, a pair of stays each having a first end connected to the tubular sleeve, one adjacent each end thereof, and a second end which is hook-shaped, said first pair of spaced apart frame members being spaced from the adjacent end f said sleeve a sufficient distance to permit the hook-shaped second end to hook over an adjacent one of said first pair of frame members to be retained thereon when in a storage position and being connectable to the mid-section to retain the undercarriage thereon in use.

11. A boat as claimed in claim 1 further comprising centering means for longitudinally aligning the sections when the boat is assembled comprising complimentary mating elements arranged one on the forward bulkhead and one on the aft bulkhead of the mid-section and stern section respectively and one on the forward bulkhead and one on the aft bulkhead of the mid-section and bow section respectively, said complimentary mating element being arranged to mate with one another when the sections are assembled for sailing and serving to retain the sections against lateral displacement with respect to one another.

12. A boat assembly as claimed in claim 1, further comprising a pair of oars, each of which has an oar pin recess formed therein and an oar pin pivotally mounted on each oar for movement between a first position in which it is disposed within its associated oar pin recess and a second position in which it projects laterally from its associated oar for use as an oar pivot pin, each oar comprises a blade component and a handle component, the handle component being arranged to telescope within the blade component between an extended position for use in rowing and shortened position for use in stowing the oars, the length of the oars when in the shortened position being less than the width of the forward bulkhead of the stern section whereby the oars may be stowed in the stern section adjacent its forward end in a position extending transversely of the stern section, the oar pin recess is formed in the handle portion of each oar and is located so as to be positioned within the blade portion when the handle portion is telescoped within the blade portion.

13. A knock-down boat assembly comprising:

bow, mid and stern water-tight transverse hull sections, each having, fore and aft ends, concave side walls and a transverse bulkhead at the aft end of the bow section, at the fore and aft ends of the mid section and at the fore end of the stern section, the stern section being nestable in the mid-section and the bow section being nestable in the stern section when in the knock-down configuration, secured in the forward bulkhead of the stern section being a position butting against the aft bulkhead of the mid-section and the aft bulkhead of the bow section being secured in a position butting against the fore bulkhead of the mid-section when the boat is assembled for sailing, the side walls of the mid-section each having a short length extending from the aft bulkhead thereof which extends obliquely outwardly from the plane of the longitudinal curvature of the stern section at an angle of 30° to the longitudinal plane of the hull such that the width of the aft end of the mid-section increases rapidly to a greater width than the fore end of the stern section whereby the stern section is nestable within the mid-section with the forward bulkhead located more closely adjacent the aft bulkhead than would be possible with a smooth longitudinal arc of curvature, the side wall of each section has an upper edge trimming, the trimming of the stern section extending level with the maximum height of the trimming of the mid-section and the maximum height of the trimming of the bow section to form a flat upper edge of the nested assembly, each section has a bottom wall portion and a buoyant linear member attached to the bottom wall of each section, the maximum height of the trimming of the bow section, when nested ion the stern section and resting on the buoyant linear of the stern section being no greater than that of the stern section, the buoyant linear member of the mid-section has a maximum height at its aft bulkhead and a buoyant linear of the stern section has a maximum height at its fore end to facilitate level nesting of the sections, each bulkhead having an upper edge and a seat mounting flange projecting inwardly from its associated section and spaced downwardly from said upper edge, each flange having a pair of notches extending inwardly from the inner edge thereof, and a pair of buoyant seat members each having an underside formed with a mounting channel which extends longitudinally thereof, lug means projecting inwardly from each side of said channel, said lug means being arranged to pass through said notches as the seat is lowered into a position bridging adjacent bulkheads, said seat being longitudinally displaceable when lowered to remove the lugs from alignment with the notches and to retain the adjacent bulkheads in intimate contact with one another, each seat cushion having a pair of belts mounted at spaced apart points thereon, said belts being connectable to one another to secure the buoyant seat cushion to the body of a boat passenger whereby the seat cushion may function as a life preserver, stabilizer tanks releasably mounted one on either side of the stern section adjacent the aft bulkhead thereof, each stabilizer tank having an inner face shaped to conform to the side wall of the stern section which they face when mounted thereon and an outer side face shaped to conform to the configuration of the inner face of a side wall of the bow section adjacent the bow end thereof whereby said stabilizer tanks may be positioned in the bow section for storage with the inner faces thereof disposed opposite one another and the outer faces arranged in a face-to-face relationship with the inner faces of the storage compartment of the bow section, tendon mounting means on said bow section and on said stern section, and tendon means mountable on the bow and stern mounting sections and extending externally and longitudinally between the bow and stern sections when the boat is assembled for sailing to retain the boat in a sailing configuration, and means for connecting opposite ends of said tendon means when the tendon means is extended around the knock-down assembly in the nested configuration in a fore to aft direction whereby the tendon means serve to retain the hull sections in the nested configuration, a pair or oars, each of which has an oar pin recess formed therein and an oar pin pivotally mounted on each oar for movement between a first position in which it is disposed within its associated oar pin recess and a second position in which it projects laterally from its associated oar for use as an oar pivot pin, each oar comprising a blade component and a handle component, the handle component being arranged to telescope within the blade component between an extended position for use in rowing and shortened position for use in stowing the oars, the length of the oars when in the shortened position being less than the width of the forward bulkhead of the stern section whereby the oars may be stowed in the stern section adjacent its forward end in a position extending transversely of the stern section, the oar pin recess being formed in the handle portion of each oar and is located so as to be positioned within the blade portion when the handle portion is telescoped within the blade portion, the bow section being formed with a fish storage compartment, said fish storage compartment having passage means opening therefrom through said bow section to permit flooding of the fish storage compartment when the boat is floating on a body of water in use, an inflatable bladder in said fish storage compartment, said bladder being proportioned to substantially fill said fish storage compartment when inflated to expel water from said fish storage compartment and increase the buoyancy of said bow section when said fish storage compartment is not in use for storing fish, a stern seat panel hingedly mounted on an inner face of a side wall of the stern section adjacent the aft bulkhead of the stern section for movement between a laterally extending seating position and a downwardly folded storage position in which said seating panel extends in a face-to-face relationship with respect to the adjacent side wall of the stern section, a wheeled undercarriage for use when towing the knockdown boat along a roadway in an upright configuration or on its side, said undercarriage comprising a tubular sleeve, a pair of wheels each mounted for rotation on a stub shaft, said stub shafts being mounted one in each end of said sleeve and being arranged to telescope therein between an extended position in which the wheels are located laterally outwardly from the boat assembly when arranged in the upright configuration and a retracted position in which the wheels are located laterally outwardly from the boat assembly when arranged on its side, and means for releasably locking said stub shaft with respect to said tubular sleeve to releaseably retain said wheels in said extended or retracted position, a support frame which is mounted on said tubular sleeve, said support frame comprising a first pair of spaced frame members projecting radially from the tubular sleeve, a back wall extending perpendicularly from said first pair of frame members, a pair of stay each having a first end connected to the tubular sleeve, one adjacent each end thereof, and a second end which is hook-shaped, said first pair of spaced apart frame members being spaced from the adjacent end of said sleeve a sufficient distance to permit the hook-shaped second end to hook over an adjacent one of said first pair of frame members to be retained thereon when in a storage position and being connectable to the mid-section to retain the undercarriage thereon in use, centering means for longitudinally aligning the sections when the boat is assembled comprising complimentary mating elements arranged one on the forward bulkhead and one on the aft bulkhead of the mid-section and stern section respectively and one on the forward bulkhead and one on the aft bulkhead of the mid-section and bow section respectively, said complementary mating element being arranged to mate with one another when the sections are assembled for sailing and serving to retain the sections against lateral displacement with respect to one another.

14. A knock-down boat assembly comprising;

bow, mid and stern water-tight transverse hull sections, each having, fore and aft ends, concave side walls and a transverse bulkhead at the aft end of the bow section, at the fore and aft ends of the mid section and at the fore end of the stern section, the stern section being nestable in the mid-section and the bow section being nestable in the stern section when in the knock-down configuration, the forward bulkhead of the stern section being secured in a position butting against the aft bulkhead of the mid-section and the aft bulkhead of the bow section being secured in a position butting against the fore bulkhead of the mid-section when the boat is assembled for sailing, the side walls of the mid-section each having a short length extending from the aft bulkhead thereof which extends obliquely outwardly from the plane of the longitudinal curvature of the stern section such that the width of the aft end of the mid-section increases rapidly to a greater width than the fore end of the stern section whereby the stern section is nestable within the mid-section with the forward bulkhead located more closely adjacent the aft bulkhead than would be possible with a smooth longitudinal arc of curvature, each bulkhead has an upper edge and a seat mounting flange projecting inwardly from its associated section and spaced downwardly from said upper edge, each flange having a pair of notches extending inwardly from the inner edge thereof, and a pair of seat members each having an underside formed with a mounting channel which extends longitudinally thereof, lug means projecting inwardly from each side of said channel, said lug means being arranged to pass through said notches as the seat is lowered into a position bridging adjacent bulkheads, said seat being longitudinally displaceable when lowered to remove the lugs from alignment with the notches and to retain the adjacent bulkheads in intimate contact with one another.

15. A boat as claimed in claim 14, wherein each seat has a buoyancy seat cushion thereon.

16. A boat as claimed in claim 15, wherein each seat cushion has a pair of belts mounted at spaced apart points thereon, said belts being connectable to one another to secure the buoyant seat cushion to the body of a boat passenger whereby the seat cushion may function as a life preserver.

* * * * *